US006564611B2

(12) United States Patent
Harrington et al.

(10) Patent No.: US 6,564,611 B2
(45) Date of Patent: May 20, 2003

(54) HYDRAULIC PRESS BRAKE TOOL HOLDER

(75) Inventors: Heath E. Harrington, Coon Rapids, MN (US); David M. Runk, St. Joseph, WI (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 09/917,981

(22) Filed: Jul. 30, 2001

(65) Prior Publication Data

US 2003/0019272 A1 Jan. 30, 2003

(51) Int. Cl.[7] ..... B21D 37/04
(52) U.S. Cl. ..... 72/481.2; 72/482.2
(58) Field of Search ..... 72/452.8, 452.9, 72/481.1, 481.2, 482.1, 482.2

(56) References Cited

U.S. PATENT DOCUMENTS

| | | | | |
|---|---|---|---|---|
| 4,497,194 A | | 2/1985 | Martin et al. | |
| 4,506,538 A | * | 3/1985 | Jones, Jr. | 72/481.2 |
| 4,545,232 A | | 10/1985 | Martin et al. | |
| 4,895,014 A | | 1/1990 | Houston | |
| 4,993,255 A | | 2/1991 | Treillet | |
| 5,065,610 A | | 11/1991 | Yonezawa | |
| 6,000,273 A | * | 12/1999 | Stover | 72/481.1 |
| 6,003,360 A | | 12/1999 | Runk et al. | |
| 6,151,951 A | | 11/2000 | Kawano | |
| 6,446,485 B1 | * | 9/2002 | Tarasconi | 72/481.1 |
| 6,450,004 B1 | * | 9/2002 | Edmondson et al. | 72/481.1 |

FOREIGN PATENT DOCUMENTS

| | | |
|---|---|---|
| FR | 2250606 | 6/1975 |
| SU | 986568 | 8/1988 |
| SU | 1569073 | 6/1990 |

* cited by examiner

*Primary Examiner*—Lowell A. Larson
(74) *Attorney, Agent, or Firm*—Fredrikson & Byron, P.A.

(57) ABSTRACT

Press brake tool holders suitable for releasing and securing press brake tools in response to applied fluid pressure. One press brake tool holder includes a horizontally elongated body having a cam shaft bore disposed longitudinally therethrough, and receiving a slidably and sealingly mounted cam shaft therein. The cam shaft can have at least one axial camming surface, having a large outer diameter region axially tapered to a small outer diameter region, and in contact with a cam follower pin slidably disposed in a cam follower pin bore transversely disposed through the body. The cam follower pin can bear against a pivotally mounted clamp disposed about the body. In response to applied fluid pressure, the camming surface can slide axially, thereby increasing the effective outer diameter as seen by the cam follower pin, thereby urging the cam follower pin outward and against the upper portion of the pivotally mounted clamp, and closing the lower clamp portion about a press brake tool. One press brake tool has a pair of opposed cam shaft segments with the pressure-bearing faces disposed near each other in the center. Another press brake tool holder has a single cam shaft with multiple camming surfaces disposed over the length.

13 Claims, 4 Drawing Sheets

HYDRAULIC PRESS BRAKE TOOL HOLDER

FIELD OF INVENTION

The present invention is related generally to press brakes which can be used to bend and form sheet metal. More specifically, the present invention relates to press brake tool holders.

BACKGROUND OF THE INVENTION

Press brakes commonly are equipped with a lower table and an upper table, one of which, commonly the upper table, is vertically movable toward the other table. Forming tools are mounted to the tables so that when the tables are brought together, a workpiece between the forming tables is bent into an appropriate shape. It is common for the upper table to include a male forming tool having a bottom workpiece-deforming surface of a desired shape, such as a right angled bend, and for the bottom table to have an appropriately shaped and aligned tool, such as a "V" shaped working surface, so that when the tools are brought together, a workpiece between the tools is given an appropriate bent shape. The forming tools commonly are horizontally elongated so that workpieces of various widths can be accommodated.

It often is necessary to exchange forming tools when a different bending operation is to be performed. The forming tools mounted to the upper table of a press brake often are not easily replaced. Forming tools usually are held by a clamp of a tool holder to the horizontally elongated bed of the upper table. Once the clamp has been loosened, the forming tool can, in some instances, be removed downwardly, and in others, must be removed by horizontally sliding it from the clamp. If a long forming tool is to be replaced, it becomes difficult to slide the forming tool from its clamp because of the proximity of neighboring clamps and forming tools which may themselves have to be removed in order to complete the tool exchange process.

Long forming tools can be quite heavy. When a holder is loosened to the point that the tool can be removed by moving it downwardly, care must be taken to prevent the tool from slipping immediately from the clamp.

Several press brake holders have been devised in an effort to facilitate the exchange of one forming tool for another. For example, Treillet, U.S. Pat. No. 4,993,255 discloses a tool holder that is attached by means of a C clamp to the bed of the upper table. Through the use of a camming mechanism, the upwardly extending shank of a forming tool is captured between a pivotable clamp and a portion of the holder, the shank and clamp having cooperating surfaces enabling the tool to be readily inserted in the holder. A locking cam is employed to lock the clamp against the forming tool. Kawano, U.S. Pat. No. 5,513,514, U.S. Pat. No. 5,511,407, U.S. Pat. No. 5,572,902, and European patent publication 0 644 002 A2 show tool holders of the same general type in which a pivoting clamp is employed to receive the shank of a tool between it and the mounting plate of the holder. In each of these patents, the holder is equipped with a threaded mechanism operated by a lever that pivots from side to side to lock and unlock the clamp, force being transmitted from the lever to the clamp via a spring structure.

Kawano, U.S. Pat. No. 6,151,951, discusses a tool holder having multiple hydraulically actuated pistons to transmit the clamping force of hydraulic fluid to a tool clamp. The multiple pistons are displaced outwardly to force the tool clamp shut.

U.S. Pat. No. 6,003,360 (Runk et al.), herein incorporated by reference in its entirety, provides an improved press brake tool holder. The tool holder includes a clamp which opens to a position allowing manual removal of the tool while not allowing the tool to fall. The clamp is controlled with a manual lever.

What would be desirable are clamps more suitable for remote and/or powered operation. Clamps suitable for hydraulic control would be advantageous.

SUMMARY OF THE INVENTION

The present invention includes a press brake tool holder for mounting to a press brake tool having a mounting shank. The tool holder is adapted to be controlled by a fluid pressure source, for example, by hydraulic fluid. One press brake tool holder includes a body having a support plate, and a clamp having upper and lower portions pivotally attached between the upper and lower portions to the body to enable the tool mounting shank to be clamped between the clamp lower portion and the body support plate. In one tool holder, the body has a cylindrical bore formed therein, and has a fluid entry port for delivering pressurized fluid to a fluid entry location within the bore. An elongate shaft having a camming surface along its length can be disposed within the bore and be slidable axially within the bore in response to fluid delivery under pressure into the bore. The camming surface can extend between a larger outer diameter region and a smaller outer diameter region, and is preferably continuously tapered in between. The body can have a cam follower engagable with the tapered camming surface and movable in response to axial movement of the shaft, so as to force the clamp to pivot with respect to the body. The pivoting clamp thereby forces the lower portion of the clamp toward or away from the support plate, to clamp or unclamp the tool mounting shank.

Some tool holders have a biasing element mounted at the end of the bore to urge the shaft toward the fluid entry location. The tapered camming surface can be oriented so as to encounter and bear against the cam follower either as the shaft slides toward or away from the biasing element, depending on the embodiment. In one tool holder, the elongated shaft has at least two axially spaced tapered camming surfaces, and the body includes at least two cam followers engageable respectively with the tapered camming surfaces.

Other tool holder embodiments include two of the elongate shafts slidably disposed within the bore, and have the fluid entry port positioned to deliver pressurized fluid between the shafts to urge them in opposite directions. The body can have at least two cam followers engageable respectively with the tapered camming surfaces of the elongated shafts. The tool holder can have biasing elements mounted at the ends of the bore to urge the shafts toward each other. The tapered camming surfaces can be oriented so as to encounter and bear against the cam followers either as the shafts slide toward or away from the biasing elements, depending on the embodiment.

The cam shaft camming portion can have a larger outer diameter region and a smaller outer diameter region joined by a tapering surface. The effective outer diameter of the tapered surface in contact with an axially stationary cam follower is increased by forcing the cam shaft to travel axially against a biasing spring, thereby forcing the cam follower outwardly. The cam shaft thus can be displaced longitudinally by the application of hydraulic pressure against a pressure-bearing, slidably sealed face of the cam shaft and by action of the biasing spring.

One embodiment of the invention includes a pair of identical symmetrically, opposed cam shafts or cam shaft segments having pressure-bearing faces disposed near each other within the cam shaft bore, and in communication with the pressurized fluid source. In response to applied fluid pressure, the twin cam shafts can be forced apart from each other and toward respective biasing springs, thereby increasing the effective outer diameter of the camming regions as presented to the cam followers. In response to the increased effective outer diameter of the camming regions, the cam follower pins are pushed outward, thereby pushing against an upper portion of the pivotally mounted clamp, and closing the lower portion of the clamp against the press brake tool shank. In response to the loss of fluid pressure, or a significant reduction in pressure, the effective outer diameter of the cam shaft camming region can be decreased. This allows the cam shaft follower pin to travel inward toward the axis of the cam shaft. This allows the clamp upper portion to travel inward, and the clamp lower portion to travel outward and away from the tool shank. In a preferred embodiment, when the clamp lower gripping portion travels outward, the tool shank is still held by a lip or notch, placing the tool into a position where it can be manually removed, yet not allowing the tool to fall under gravity prior to the manual removal.

In another embodiment of the invention, the cam shaft includes a single shaft segment having at least two camming surfaces. In this embodiment, a pressurized fluid source can be used to apply pressure to one end of the cam shaft, thereby causing the cam shaft and all camming surfaces thereon to move axially through the cam shaft, causing the cam follower pins to move in response.

Some embodiments of the invention are configured such that the cam follower pins apply force above the clamp pivot pins. Some embodiments of the invention increase the effective camming region outer diameter in response to applied pressure, while others embodiments have the reverse camming surface slope. In particular, some embodiments increase the camming surface effective outer diameters by decreasing the applied fluid pressure. Some embodiments of the present invention cause the clamps to fail open under loss or reduction of fluid pressure, while others cause the clamps to fail shut under the loss or reduction of fluid pressure. The present invention provides hydraulically operated press brake tool holders which can be operated by foot switches or automatically controlled hydraulic switches.

DETAILED DESCRIPTION OF THE PREFERRED EMBODIMENTS

Figure 1:
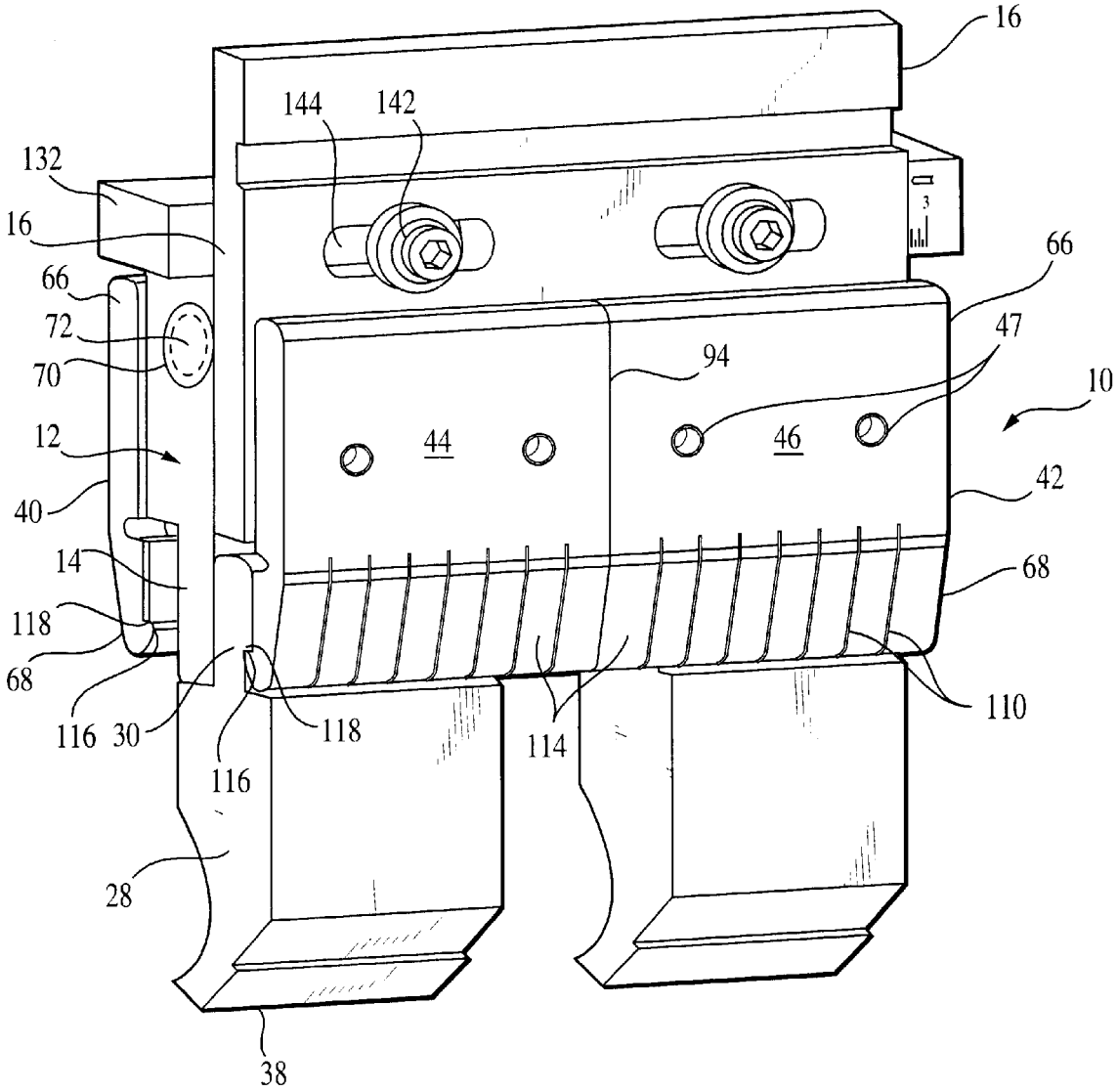
FIG. 1 is a perspective view of a brake press tool holder, including a body, and a clamp having opposed clamp elements holding a brake press tool.

FIG. 1 illustrates a tool holder 10, illustrated holding a tool 28. Tool 28 includes a lower workpiece encountering edge 38, which can be used to form sheet metal pieces into the desired shape. Tool holder 10 includes generally a horizontally elongated body 12 and a mounting plate 16. Mounting plate 16 has a clamp attached thereto, including opposed clamp elements 42 and 40. Clamp elements 40 and 42 are pivotally attached to mounting plate 16 about parallel spaced pin apertures 47. Body 12 includes a lower support plate portion 14, having a bottom edge 26. Mounting plate 16 includes elongated slots 144, which are used to couple the mounting plate to a wedge 132 using threaded bolts 142 disposed through elongated slots 144. Clamp element 42 may be seen to be divided into a first clamp unit 44 and a second clamp unit 46 by a center thin slot 94.

Clamp element 42 may also be seen to include a plurality of downwardly extending finger elements 114 for resiliently gripping tool 28 by a tool shank portion 30. Clamp element 42 also includes a longitudinal slot 112 which can also impart resiliency to clamping tool shank 30. Downwardly extending finger elements 114 are separated from each other by a plurality of spaced, parallel, thin slots 110. Clamp element 42 is divided by pin apertures 47 into an upper clamp portion 66 and a lower clamp portion 68. Lower clamp portion 68 includes, in the embodiment shown, an inwardly turned lip 116 having an upwardly facing shoulder 118. Clamp element 42 may be seen to pivot about pin apertures 47, causing clamp lower portion 68 to grip tool shank 30 using inwardly turned lip 116. Inwardly turned lip 116 forces tool shank 30 against body support plate portion 14. Tool holder body 12 includes an end cap 70 capping a horizontal bore 72 (shown in phantom) which contains a cam shaft (not shown in FIG. 1). In some embodiments, cam follower pins (not shown in FIG. 1) push outwardly on upper clamp portion 66, thereby causing clamp lower portion 68 to close about tool shank 30. In these embodiments, clamp lower portion 68 may be biased by springs to open outwardly from tool shank 30, thereby releasing or placing the tool in a position where it can be removed. In a preferred embodiment, the cam shaft slides axially within cam shaft bore 72, causing the cam follower pins to push outwardly on clamp upper portion 66.

Figure 2:
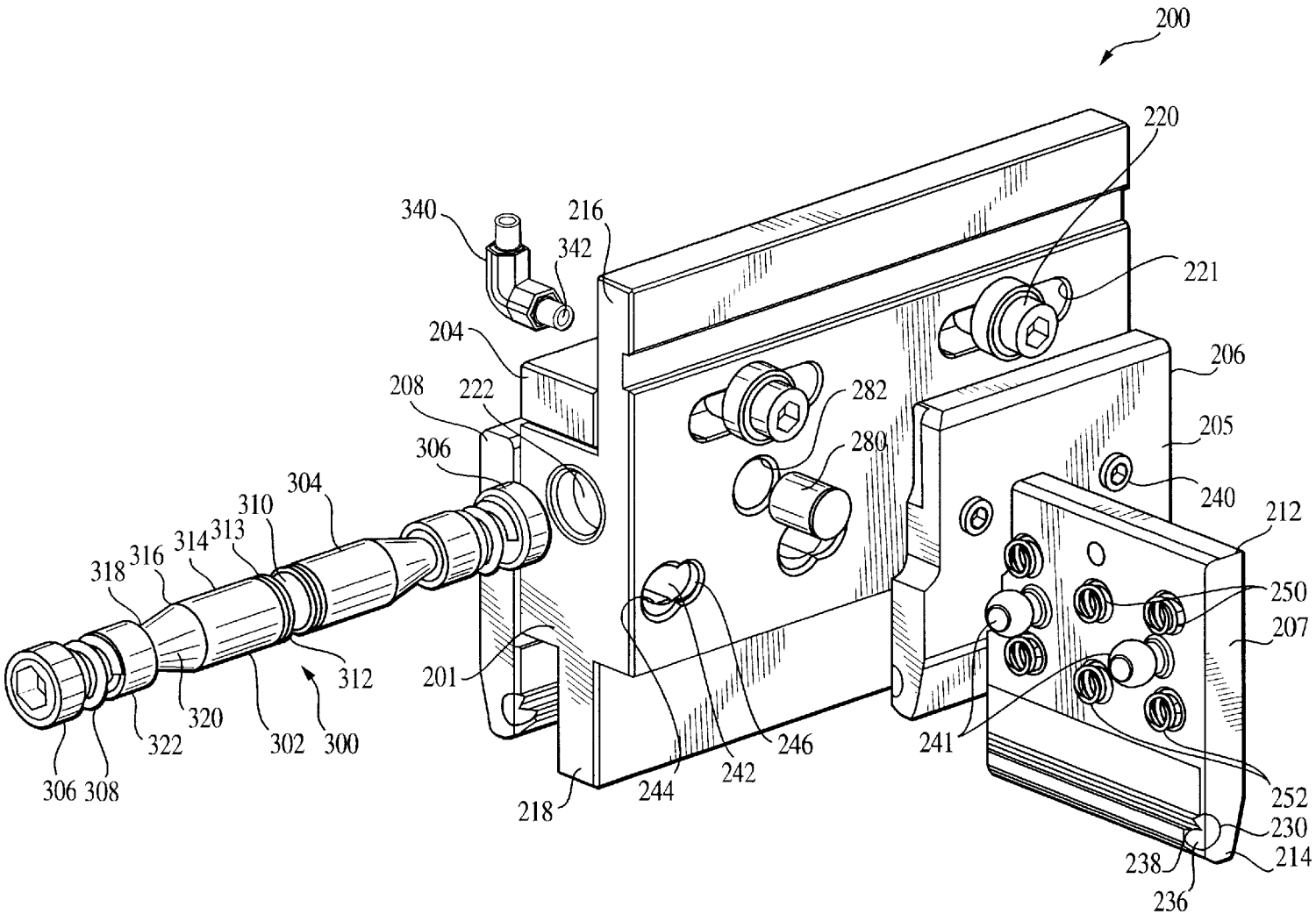
FIG. 2 is an exploded, perspective view of another embodiment of a brake press tool holder having two, symmetrical, opposed cam shaft segments adapted to be forced apart under fluid pressure for the purpose of forcing cam follower pins outward against pivoting, enclosing tool clamping elements.

FIG. 2 is an exploded, perspective view of another tool holder 200, illustrating, a preferred embodiment of the invention. Tool holder 200 includes generally a body 201, a first clamp element 206, a second opposing clamp element 208, a wedge 204, and a cam shaft bore 222 through body 201 for receiving a cam shaft 300. As used herein, "camshaft" refers to an axially slidably shaft having a camming surface including a larger outer diameter region and a smaller outer diameter region and having a tapered, preferably conical surface therebetween. In a preferred embodiment, the camming surface is axially and conically tapered rather than stepped.

Wedge 204 is coupled to body 201 by threaded bolts 220 extending through elongated slots 221 through body 201. First clamp element 206 may be divided into a clamp upper portion 212 and a clamp lower portion 214 by horizontally spaced pin recesses 240, which can receive rounded head pins 241. Horizontally aligned apertures 242 are disposed in body 201, for receiving rounded head pins 241. Apertures 242 include an enlarged end opening portion 244 and an undercut slot portion 246.

First clamp element 206 may be seen to include a plurality of compression springs, including upper compression springs 250 and lower compression springs 252. The compression springs can operate to bias first clamp element 206 away from body 201.

Each clamp member unit half can be provided with horizontally spaced pins 241, each pin having a threaded end that is received in a threaded bore formed in the clamp. Each pin has an enlarged, rounded head. As shown in FIG. 2, body 201 includes the plurality of horizontally aligned apertures 242. Each aperture forms a horizontally elongated slot having the enlarged end opening 244 and the undercut slot portion 246. The enlarged, rounded heads of the pins are sized so as to be received through the enlarged end openings 244 of the slots. When in this position, the individual clamps are slid horizontally toward the center line of the tool, the enlarged, rounded heads sliding into engagement with the undercut surfaces 246 of the slots. In this manner, each clamp half can be released from the clamping tool by sliding the clamp horizontally away from the midline of the tool until the pins become aligned with the enlarged openings 244, whereupon the clamp halves can simply be removed from the support plate and mounting plate, respectively.

The series of compression springs 250 are mounted between the confronting surfaces of the clamp and the support plate or mounting plate, respectively, so that when the enlarged, rounded ends of pins 241 are received within the undercut surfaces of the slot 246, the springs 250 and 252 tend to push the clamps away from the body such that each clamp is tethered to the body of pins 241.

First clamp element 206 may also be seen to include a longitudinal recess 230 within first clamp element 206. Longitudinal recess 230 can be substantially circular in profile and have therein a tool shank gripping member 236, including a tool gripping lip 238. Tool gripping number 236 may be rotatable about its longitudinal axis. Body 201 may also be seen to have a cam follower pin bore 282 for receiving a cam follower pin or element 280 within.

Cam shaft 300 includes, in the embodiment shown, a first cam shaft segment 302 and a second cam shaft segment 304. Cam shaft segment 302 and cam shaft segment 304 are alternatively referred to herein as first cam shaft 302 and second cam shaft 304, respectively. In the embodiment illustrated, first cam shaft 302 and second cam shaft 304 are identical, and the various elements of the cam shafts may be described with reference to either first cam shaft 302 or second cam shaft 304. Cam shafts 302 and 304 may be held in place within cam shaft bore 222 by end caps 306. First cam shaft 302 may be seen to be biased away from end cap 306 by a biasing spring 308. First cam shaft 302 and second cam shaft 304 have a gap 312 therebetween for receiving a pressurized fluid. The first and second cam shafts also include a face 310 for receiving the fluid pressure and sealing rings 313 for sealingly containing the pressurized fluid. The pressurized fluid is preferably a hydraulic fluid. First cam shaft 302 may be seen to include generally a substantially constant outer diameter cam shaft portion 314 extending to a camming surface portion 320, which includes a larger diameter region 316 and a smaller diameter region 318. Cam shaft 302 abuts biasing spring 308 at an enlarged end region 322.

A pressurized fluid source is illustrated generally by a pressurized fluid conduit 340, having an elbow shape and containing a pressurized fluid lumen 342 within. Pressurized fluid source 340 may be used to supply pressurized fluid through an entry port in body 201 to enter cam shaft gap 312. The pressurized fluid forces first and second cam shafts 302 and 304 apart from each other and against biasing springs 308. As the cam shafts travel toward their outer biasing springs, the effective outer diameter of the cam shaft, as seen by the cam follower pins, increases from smaller diameter region 318 to larger diameter region 316. Cam shaft follower pin 280, received within cam shaft follower pin bore 282, travels over the camming surface 320. In some embodiments, at one extreme of travel, cam shaft follower pin 280 rests upon a sloped, tapered larger outer diameter region such as region 316. In other embodiments, cam shaft follower pin 280 rests upon a constant larger outer diameter region such as region 314. Resting upon a constant outer diameter region can eliminate any axial component of force transmitted by the follower pin to the cam shaft. As the effective outside diameter of the cam shaft increases, cam follower pin 280 is forced outward against first clamp element 206. In one embodiment, cam shaft follower pin 280 is forced against first clamp element 206 upper portion 212, thereby forcing lower portion 214 closed to grip a tool shank.

Similarly, when a reduced pressure, or even a vacuum, is applied through pressurized fluid source 340 to enter cam shaft gap 312, the cam shafts travel inward, bringing faces 310 toward each other, as a result of the force applied by the biasing springs 308. This changes the effective diameter of the cam shaft by decreasing the effective outer diameter, thereby allowing the cam shaft follower pins to travel inward into body 201, thereby causing first clamp element 206 upper portion 212 to travel inward toward body 201. The forcing of first clamp element 206 against cam shaft follower pin 280 can be caused by biasing springs 252 in some embodiments.

Figure 3:
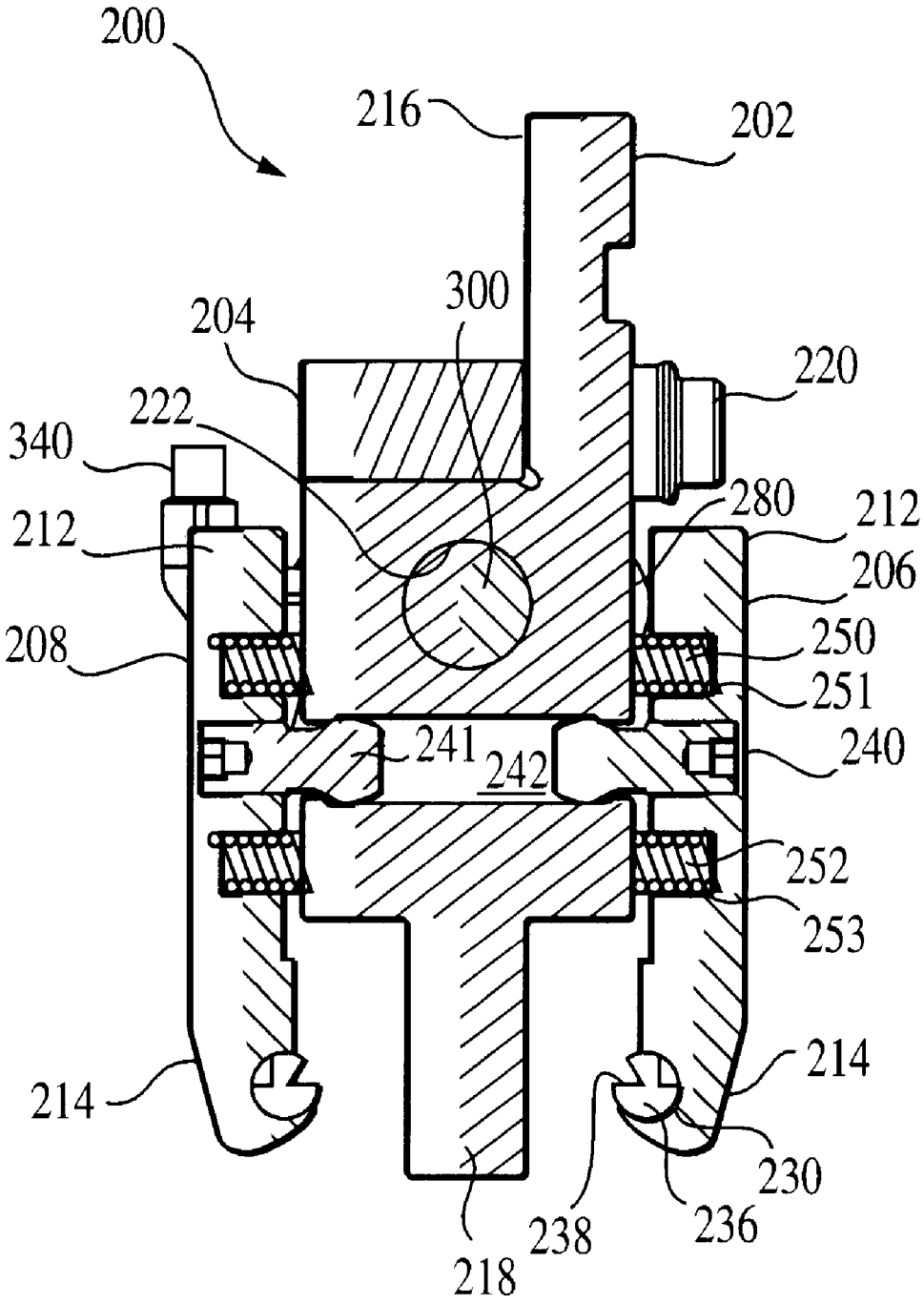
FIG. 3 is a transverse cross-sectional view taken through FIG. 2, illustrating the pivotally mounted and spring biased clamp elements coupled to a body.

FIG. 3 illustrates a transverse cross-sectional view through brake press tool holder 200 of FIG. 2. Elements identically numbered with respect to FIG. 2 are similar in FIG. 3 and need not be reintroduced. Rounded head pins 241 may be seen to be received within aperture 242 and aligned with pin recesses 240 in first clamp element 206 and second clamp element 208. Clamp biasing springs may be seen to be mounted within upper spring receiving pockets 251 and lower spring receiving pockets 253. Cam shaft follower pin 280 may be seen to be disposed against first clamp element 206 upper portion 212. Rotatable tool gripper 236 may be seen to include gripping notched portion 238 therein. In FIG. 3, cam shaft 300 may also be seen to be slidably disposed within cam shaft bore 222.

Figure 4:
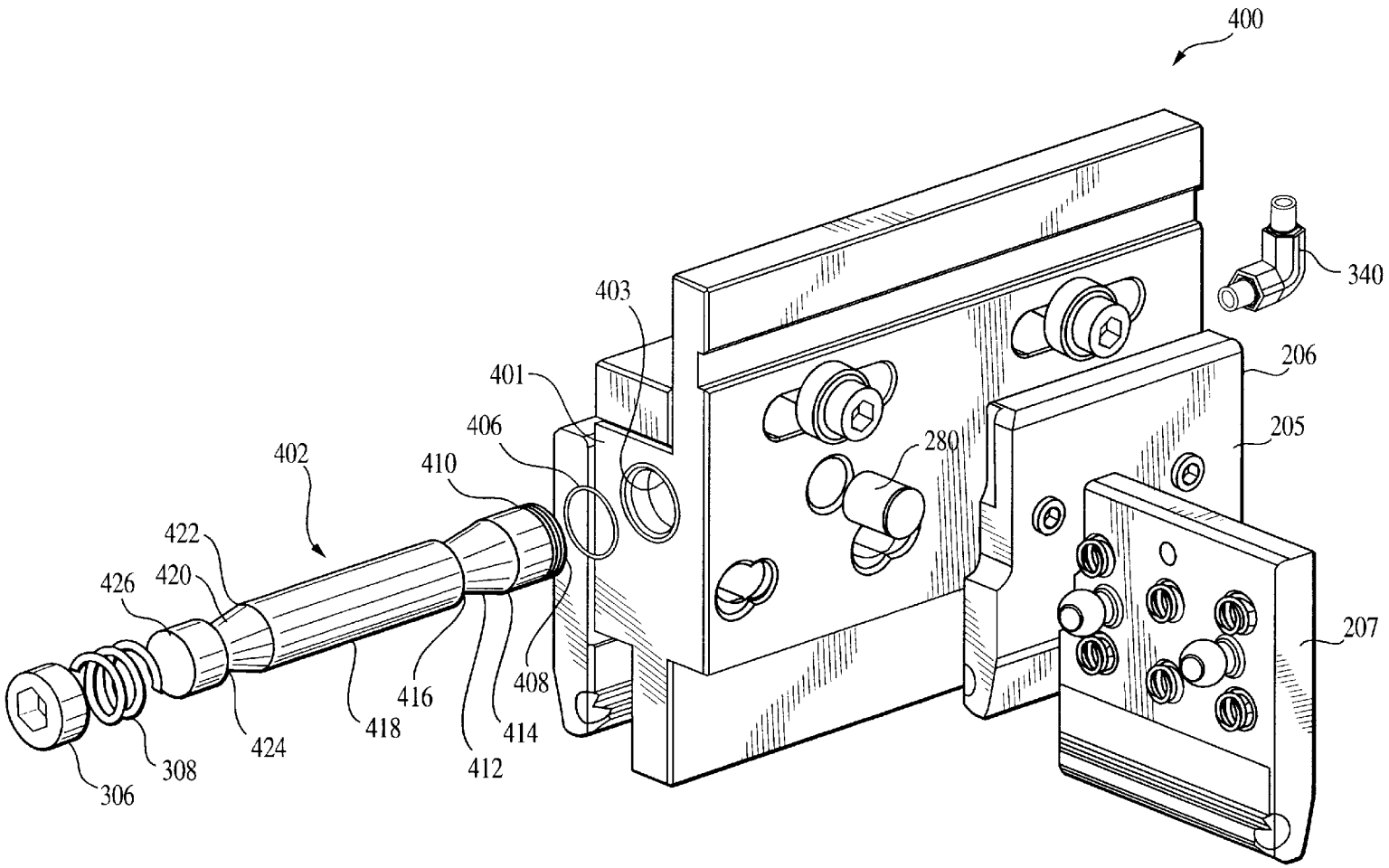
FIG. 4 illustrates yet another tool holder embodiment having a single cam shaft with two camming surfaces disposed thereon.

FIG. 4 illustrates another embodiment of the invention in a tool holder 400. Tool holder 400 is similar in many respects to tool holder 200 of FIGS. 2 and 3, but having a differing cam shaft design and fluid entry port location. Tool holder 400 includes a tool holder body 401, having a cam shaft bore 403 longitudinally disposed therethrough. Cam shaft bore 403 is in fluid communication with pressurized fluid source 340, which may be coupled to one end of cam shaft bore 403. An O ring 406 is illustrated near cam shaft pressure-bearing face 408, which may be described as the proximal-most face of cam shaft 402. A shaft region 410 proceeds distally to a first camming region or surface 412, which includes a proximal, larger outer diameter, region 414 tapering axially to a smaller outer diameter more distal region 416. Cam shaft 402 proceeds still more distally to a general midshaft substantially constant outer diameter portion 418, and proceeding further distally to a second camming surface or region 420, including a larger outer diameter region 422, tapering axially to a smaller outer diameter 424, which proceeds distally to a cam shaft distal-most end portion 426. End portion 426 bears against biasing spring 308 which seats against end cap 306.

Tool holder 400 operates using pressurized fluid, as did tool holder 200. Pressurized fluid, for example, hydraulic fluid or high pressure (pneumatic) air, may be supplied through pressure source 340, into cam shaft bore 404, against O ring 406 and pressure-bearing face 408, thereby forcing cam shaft 402 distally against biasing spring 308 and end cap 306. As cam shaft 402 is forced distally, the effective outer diameter of camming regions 412 and 420 increase. The increased effective outer diameter forces cam follower pin 280 outward against the upper portion of clamp element 206, thereby forcing the clamp lower portion to close about the tool shank.

Various other embodiments of the invention may be described with reference to the previously discussed figures without requiring substantially duplicative figures. In one aspect of the invention, the placement of cam follower pin 280 relative to rounded head pivot pins 241 may be varied between embodiments. Placing the cam follower pin above the pivot pins can provide an embodiment in which the applied fluid pressure causes the clamp to grip the brake press tool, while the loss of pressure causing the releasing of the tool. In a preferred embodiment, the loss of pressure, whether intentional or unintentional, places the tool in a position where the tool can be removed by hand rather than causing the tool to drop. Such an operation is described in U.S. Pat. No. 6,003,360. In another embodiment, the cam follower pin is disposed beneath the pivot pins, thereby creating an embodiment in which the fluid pressure causes the jaws to open, and the loss of fluid pressure allows a clamp biasing spring to close the clamp about the tool.

Another aspect of the invention may be described with respect to FIG. 4. In some embodiments, the slope of the camming surface is reversed with respect to that illustrated in cam shaft 402 in FIG. 4. In particular, the larger outer diameter portion is distally further from the pressure bearing face than the smaller outer diameter portion. With respect to the slope of the camming surface, this may be illustrated by viewing cam shaft 402 as inserted into cam shaft bore 404 such that end 426 serves as the pressure-bearing face, rather than pressure-bearing face 408. In this configuration, the effective outer diameter of the cam shaft decreases as the cam shaft travels distally against spring 308, thereby allowing cam follower pin 280 to travel inward as pressure is applied through fluid pressure source 340. This allows the upper portion of clamp element 206 to travel inward, thereby allowing the lower tool gripping portion to travel outward, putting the clamp into a position where the tool shank can be removed. In this embodiment, the loss of fluid pressure, either intentional or unintentional, can cause the cam shaft to travel away from biasing spring 308, thereby increasing the effective outer diameter of the cam shaft, thereby forcing the cam follower pin outward, and causing the clamps to fail in a closed position. In a similar manner, the camming surface slopes of cam shaft 300 in FIG. 2 may also be reversed.

The present invention has been described with respect to specific examples and embodiments of the invention for the purposes of illustration above. The scope of the present invention is described in the claims set forth below.

What is claimed is:

1. A holder for mounting to a press brake a press brake tool having a mounting shank, the holder comprising a body having a support plate, a clamp having upper and lower portions and pivotally attached between said upper and lower portions to the body to enable the mounting shank of the tool to be clamped between said lower portion of the clamp and said support plate, the body having formed therein a cylindrical bore and having a fluid entry port for delivering pressurized fluid to a location within said bore, an elongated shaft slidable axially within said bore in response to the delivery of fluid under pressure into the bore and having a camming surface along its length, said camming surface including a first, larger outer diameter region having an outer diameter greater than a second, smaller outer diameter region, said body including a cam follower engagable with said camming surface and movable in response to axial movement of the shaft to force the clamp to pivot with respect to the body, thereby forcing the lower portion of the clamp toward or away from said support plate to clamp or unclamp the mounting shank of the tool.

2. The press brake holder of claim 1, wherein the camming surface is tapered between the larger outer diameter region and the smaller diameter region.

3. The press brake holder of claim 2, wherein the camming surface is continuously and uniformly tapered between the larger and smaller diameter regions.

4. The press brake tool holder of claim 1 including a biasing element mounted at the end of said bore to urge said shaft toward said bore location.

5. The press brake tool holder of claim 4 wherein said camming surface is oriented to encounter and bear against said cam follower as said shaft slides toward said biasing element.

6. The press brake tool holder of claim 4 wherein said camming surface is oriented to encounter and bear against said cam follower as said shaft slides away from said biasing element.

7. The press brake tool holder of claim 1 wherein said elongated shaft has at least two axially spaced camming surfaces, and wherein said body includes at least two cam followers engagable respectively with said tapered camming surfaces.

8. The press brake tool holder of claim 1 including two of said elongated shafts slidable within said bore and wherein said entry port is positioned to deliver pressurized fluid at a location between said shafts to urge them in opposite directions, and wherein said body includes at least two cam followers engagable respectively with said camming surfaces of the elongated shafts.

9. The press brake holder of claim 8 including biasing elements mounted at the ends of said bore to urge said shafts toward each other.

10. The press brake tool holder of claim 9 wherein said camming surfaces are oriented to encounter and bear against said cam followers as said shafts slide away from each other.

11. The press brake tool holder of claim 9 wherein said camming surfaces are oriented to encounter and bear against said cam followers as said shafts slide toward each other.

12. The press brake tool holder of claim 1, wherein the clamp is biased to clamp the tool mounting shank.

13. The press brake tool holder of claim 12, wherein the clamp has an upper portion and a lower portion, wherein the cam follower bears against the upper portion to urge the lower portion to clamp the tool mounting shank.

* * * * *